US008302374B2

(12) United States Patent
Marissen et al.

(10) Patent No.: US 8,302,374 B2
(45) Date of Patent: Nov. 6, 2012

(54) CUT RESISTANT YARN, A PROCESS FOR PRODUCING THE YARN AND PRODUCTS CONTAINING THE YARN

(75) Inventors: Roelof R. Marissen, Born (NL); Evert Florentinus Florimondus De Danschutter, Spaubeek (NL); Elisabeth E. Mueller, Maastricht (NL)

(73) Assignee: DSM IP Assets B.V., Heerlen (NL)

( * ) Notice: Subject to any disclaimer, the term of this patent is extended or adjusted under 35 U.S.C. 154(b) by 95 days.

(21) Appl. No.: 12/444,909

(22) PCT Filed: Sep. 6, 2007

(86) PCT No.: PCT/EP2007/007876

§ 371 (c)(1),
(2), (4) Date: Nov. 5, 2009

(87) PCT Pub. No.: WO2008/046476

PCT Pub. Date: Apr. 24, 2008

(65) Prior Publication Data

US 2010/0050309 A1 Mar. 4, 2010

(30) Foreign Application Priority Data

Oct. 17, 2006 (EP) ..... 06021680

(51) Int. Cl.
*D02G 3/02* (2006.01)

(52) U.S. Cl. ..... 57/244; 57/255

(58) Field of Classification Search ..... 57/244, 57/248, 249, 255
See application file for complete search history.

(56) References Cited

U.S. PATENT DOCUMENTS

| | | | | |
|---|---|---|---|---|
| 752,297 | A | 2/1904 | Parker | |
| 5,093,197 | A | 3/1992 | Howard et al. | |
| 5,851,668 | A | 12/1998 | Sandor et al. | |
| 5,976,998 | A * | 11/1999 | Sandor et al. | 442/365 |
| 6,103,372 | A | 8/2000 | Sandor et al. | |
| 6,952,915 | B2 * | 10/2005 | Prickett | 57/211 |
| 7,143,570 | B2 | 12/2006 | Piat | |
| 2003/0143396 | A1 | 7/2003 | Bouquerel et al. | |
| 2005/0091961 | A1 * | 5/2005 | Prickett | 57/238 |
| 2006/0110597 | A1 | 5/2006 | Koralek | |

FOREIGN PATENT DOCUMENTS

| | | |
|---|---|---|
| EP | 0 845 551 | 6/1998 |
| WO | 2006/010521 | 2/2006 |

OTHER PUBLICATIONS

International Search Report for PCT/EP2007/007876, mailed Jan. 23, 2008.

* cited by examiner

*Primary Examiner* — Shaun R Hurley
(74) *Attorney, Agent, or Firm* — Nixon & Vanderhye P.C.

(57) ABSTRACT

Cut resistant yarns are provided which include filaments and/or staple fibers, the filaments and/or staple fibers containing a hard component to improve cut resistance of the yarn. The hard component is preferably a plurality of hard fibers having an average diameter of at most 25 microns. The yarns are made by melting or dissolving a polymer while mixing the polymer and the plurality of hard fibers followed by spinning the yarn from the mixture.

20 Claims, No Drawings

CUT RESISTANT YARN, A PROCESS FOR PRODUCING THE YARN AND PRODUCTS CONTAINING THE YARN

This application is the U.S. national phase of International Application No. PCT/EP2007/007876, filed 6 Sep. 2007, which designated the U.S. and claims priority to Europe Application No. 06021680.1, filed 17 Oct. 2006, the entire contents of each of which are hereby incorporated by reference.

The invention relates to a cut resistant yarn containing filaments and/or staple fibers, the filaments and/or staple fibers containing a hard component, a process for producing the yarn and products comprising the yarn.

Cut resistant yarns and garments containing the yarn are known. Cut resistant yarns are for example used in products like garments intended to protect persons from being cut, the persons working in the meat industry, the metal industry and the wood industry. Examples of such garments include gloves, aprons, trousers, cuffs, sleeves, etc.

Examples of yarns suitable for this purpose include yarns containing filaments of aramid, ultra high molecular weight polyethylene (UHMwPE) or polybenzoxazole.

In order to further increase the cut resistance of the yarns, composite yarns were proposed, such yarns containing single yarns of the above-mentioned filaments and/or staple fibers as well as one or more metal wires. Such a yarn is for example known from EP-A445872. A garment containing the yarn shows improved cut resistance, however with respect to the comfort of the wearer there is room for further improvement. It is very important that the garment shows good wear comfort, since the persons in industry involved have to wear the garments for considerable long periods, while maintaining high productivity. If the comfort is inadequate, people tend to get fatigued, or will even refrain from wearing the protective garment. This increases the risk that accidents happen and that injuries occur.

In U.S. Pat. No. 5,976,998 a yarn is disclosed, the yarn containing polymeric filaments, the filaments containing a filler of hard particles. It is said that gloves produced from the yarn are more flexible, comfortable to wear and are easy to clean. The filler is present in an amount of about 0.05% to about 20% by weight. As the particulate filler generally a powder is used. Powder-like materials, like materials containing platelets and needles are also said to be suitable.

It is reported that it is a problem that fillers with large particle size, in case of elongated particles with a large length, give problems in passing the spinneret and also have a negative effect on the mechanical properties of the filaments. For filaments having a denier in the range of about 1.5 to about 15 dpf the particles should be filtered or sieved in such a way that particles larger than 6 microns are excluded.

It is a general problem that powder or powder-like materials that are suitable to be used as hard filler have a wide size distribution of their particles. Therefore most often too large particles are present, that cannot pass the spinneret or that at least cause problems with respect to the mechanical properties of the yarn. This means that it is in general advisable to sieve the powder or the powder-like material, even for use in filaments with larger diameters.

Handling of small particles in this way is complicated and also special measures must be taken to protect the health of workers when there is a danger of inhalation of the particles. Furthermore even after sieving the particles still give problems with respect to the mechanical properties of the yarns.

Object of the invention is to provide a cut resistant yarn containing filaments and/or staple fibers, the filaments and/or staple fibers containing a hard component, which yarn does not show the problems mentioned above.

Surprisingly this object is achieved if the yarn comprises a hard component which is a plurality of hard fibers having an average diameter of at most 25 micron.

Surprisingly the yarn according to the invention is easy to produce.

The yarn according to the invention also shows an improved cut resistance, good mechanical properties, is flexible and easy to clean.

It is very surprising that very good results are obtained by the hard fibers that even may have a length that exceeds several times the thickness of the filaments, while in case particles are used, as described in U.S. Pat. No. 5,976,998 the larger particles cause problems.

Surprisingly the yarn according to the invention is also very suitable for use in applications that require stab resistance, like for example resistance against knife stabbing or stabbing with an ice pick.

Preferably the hard fibers in the yarn according to the invention have an average diameter of at most 20 microns, more preferably at most 15 microns, most preferably at most 10 microns. In case of lower diameter of the filaments or staple fibers in the yarn preference will be given to hard fibers also with lower diameters.

Preferably at least part of the hard fibers have an average aspect ratio of at least 3, more preferably at least 6, even more preferably at least 10.

The aspect ratio of a hard fiber is the ratio between the length and the diameter of the hard fiber.

The diameter and the aspect ratio of the hard fibers may easily be determined by using SEM pictures. For the diameter it is possible to make a SEM picture of the hard fibers as such, spread out over a surface and measuring the diameter at 100 positions, ad randomly selected and than calculating the average of the so obtained 100 values. For the aspect ratio it is possible to make a SEM picture of one or more filaments in the yarn according to the invention and to measure the length of hard fibers that show up at or just below the surface of the filaments. Preferably the SEM pictures are made with backscattered electrons, providing a better contrast between the hard fibers and surface of the filaments or staple fibers.

The hard fibers of the yarn according to the invention are produced out of a hard material. Hard in the context of the invention means at least harder than the filaments or staple fibers itself without the hard fibers. Preferably the material that is used to produce the fibers has a Moh's hardness of at least 2.5, more preferably at least 4, most preferably at least 6. Good examples of suitable hard fibers include, glass fibers, mineral fibers or metal fibers.

Preferably the hard fibers are spun fibers. Advantage of such fibers is that the diameter of the fibers has a rather constant value or is at least within a certain range. Because of this there is no or only a very limited spread in the properties, for example the mechanical properties in the yarn according to the invention. This is even true when relatively high loads of hard fibers are used in the yarn according to the invention, in this way providing a yarn with excellent cut resistance.

Good examples of such spun hard fibers are thin glass or mineral fibers spun by rotation techniques well known to the skilled person.

It is possible to produce the hard fibers as continuous filaments that are subsequently milled into hard fibers of much shorter length. In an alternative discontinuous filaments may be produced by jet spinning, optionally subsequently milled and used in the filaments according to the invention or the hard fibers may be used in the length as produced for the production of the yarn according to the invention.

In a preferred embodiment carbon fibers are used as the hard fibers. Most preferably carbon fibers are used having a diameter of between 3 and 10 microns, more preferably between 4 and 6 microns.

Yarns having filaments containing the carbon fibers shows improved electrical conductivity, enabling the discharge of static electricity.

Suitable yarn according to the invention may contain 0.1-20 volume % of the hard fibers, preferably 1-10 vol. %, even more preferably 2-7 vol. %.

The titer of the filaments and/or staple fibers of the yarn according to the invention is preferably below 15 dtex per filament, more preferably 10 dtex, most preferably below 5 dtex. This is because garments produced out of such a yarn not only show a very good cut resistance, but are also very flexible, providing a high level of comfort to the persons that wear the garments.

All kind of polymers may be used for the production of the cut resistant yarn according to the invention. In general all polymers that are used for the production of yarn come into account to be used. It is possible to use polymers that are processed as a melt into yarn, as for example nylon and thermoplastic polyester. Preferably however polymers are used that are processed into yarns as a solution. Most preferably polymers are used that provide already a high level of cut resistance to yarns that are produced from the pure polymer. Examples of such polymers include aramid, UHMwPE and polybenzoxazol.

Of these polymers preferably UHMwPE is used, most preferably in the gel spinning process, to produce the yarn according to the invention.

The gel-spinning process is for example described in EP 0205960 A, EP 0213208 A1, U.S. Pat. No. 4,413,110, GB 2042414 A, EP 0200547 B1, EP 0472114 B1, WO 01/73173 A1, and Advanced Fiber Spinning Technology, Ed. T. Nakajima, Woodhead Publ. Ltd (1994), ISBN 1-855-73182-7, and references cited therein. Gel spinning is understood to include at least the steps of spinning at least one filament from a solution of ultra-high molecular weight polyethylene in a spin solvent; cooling the filament obtained to form a gel filament; removing at least partly the spin solvent from the gel filament; and drawing the filament in at least one drawing step before, during or after removing spin solvent.

In the process according to the invention any of the known solvents suitable for gel spinning of UHMWPE may be used, hereinafter said solvents being referred to as spin solvents. Suitable examples of spin solvents include aliphatic and alicyclic hydrocarbons such as octane, nonane, decane and paraffins, including isomers thereof; petroleum fractions; mineral oil; kerosene; aromatic hydrocarbons such as toluene, xylene, and naphthalene, including hydrogenated derivatives thereof such as decalin and tetralin; halogenated hydrocarbons such as monochlorobenzene; and cycloalkanes or cycloalkenes such as careen, fluorine, camphene, menthane, dipentene, naphthalene, acenaphtalene, methylcyclopentandien, tricyclodecane, 1,2,4,5-tetramethyl-1,4-cyclohexadiene, fluorenone, naphtindane, tetramethyl-p-benzodiquinone, ethylfuorene, fluoranthene and naphthenone. Also combinations of the above-enumerated spinning solvents may be used for gel spinning of UHMWPE, the combination of solvents being also referred to for simplicity as spin solvent. It is found that the present process is especially advantageous for relatively volatile solvents, like decalin, tetralin and several kerosene grades. In the most preferred embodiment the solvent of choice is decalin.

Spin solvent can be removed by evaporation, by extraction, or by a combination of evaporation and extraction routes.

Preferably the UHMwPE used to produce the yarn according to the invention has an intrinsic viscosity (IV) of at least 8 dl/g, as determined according to method PTC-179 (Hercules Inc. Rev. Apr. 29, 1982) at 135° C. in decalin, with dissolution time of 16 hours, with anti-oxidant DBPC in an amount of 2 g/l solution, and the viscosity at different concentrations extrapolated to zero concentration.

The invention also relates to a process for producing the yarn according to the invention by:

a) mixing polymer powder or polymer granules and a plurality of hard fibers,
b) melting or dissolving the polymer, while still mixing the polymer and the plurality of hard fibers
c) spinning a yarn from the mixture obtained in step b)

The preferred method is dissolving the polymer and so spinning a polymer solution containing the fibers.

In another preferred embodiment the process comprises the steps of:

a) melting or dissolving a polymer,
b) mixing the plurality of hard fibers with the molten polymer or the polymer solution,
c) spinning a yarn from the mixture obtained in step b).

The preferred method is dissolving the polymer and so spinning a polymer solution containing the fibers.

Most preferably the process for producing the cut resistant yarn is a gel spinning process for UHMwPE yarn comprising the steps of:

a) mixing UHMwPE powder and a plurality of hard fibers
b) dissolving the UHMwPE into the solvent to obtain a slurry of the hard fibers in a solution of UHMwPE
c) spinning the slurry into a yarn according to the gel spinning process.

Mixing in step a). may simply be carried out in a tumbler. After that the standard equipment for the production of a gel spun UHMwPE yarn may be used.

In another preferred embodiment the gel spinning process comprises the steps of:

a) dissolving UHMwPE powder into a solvent,
b) mixing the plurality of hard fibers with the solution obtained in step b), to obtain a slurry of the hard fibers in a solution of UHMwPE,
c) spinning the slurry into a yarn according to the gel spinning process.

Standard equipment may be used for this process, preferably a twin screw extruder, wherein in the first part the polymer is dissolved in the solvent, wherein at the end of the first part the fibers are fed to the extruder via a separate feed opening.

It is also possible to cut the yarns obtained in above-mentioned processes into staple fibers and to process these staple fibers into a yarn.

Also included in the scope of the invention are so-called composite yarns and products containing such a yarn. Such a composite yarn for example contains one or more single yarns containing filaments and/or staple fibers containing the plurality of hard fibers and one or more further single yarns or a glass, metal or ceramic yarn, wire or thread. An example of a composite yarn is a yarn containing a single yarn according to the invention twisted around a core consisting of a metal wire.

Cut resistant fabrics containing the cut resistant yarn according to the invention may be made by knitting, weaving or by other methods, by using conventional equipment. It is also possible to produce non-woven fabrics. The fabrics comprising the yarn according to the invention may have a cut resistance that is 20% higher than the same fabric, produced from the yarn not containing the hard fibers, as measured by the Ashland Cut Protection Performance Test. Preferably the cut resistance of the fabric is at least 50% higher, more preferably at least 100% higher, even more preferably at least 150% higher.

The cut resistant yarns according to the invention are suitably used in all kind of products, like garments intended to protect persons from being cut, the persons working in the meat industry, the metal industry and the wood industry. Examples of such garments include gloves, aprons, trousers, cuffs, sleeves, etc. Other possible applications include side curtains and tarpaulins for trucks, soft sided luggage, commercial upholstery, airline cargo container curtains, fire hose sheathes etc.

Surprisingly the yarns according to the invention are also very suitable for use in products used for protection against injury by stabbing, for example by a knife or an ice pick. An example of such a product is a vest for life protection used by police officers Preferably in such a structure the yarns according to the invention are located at the side of the structure where the structure will be first hit by the sharp object that is used for the stabbing.

EXAMPLES

Comparative Experiment A

UHMwPE with an IV of 27.0 dl/g was dissolved in decalin, in a concentration of 9 wt. %. The so obtained solution was fed to a twin screw extruder having a screw diameter of 25 mm, equipped with a gear pump. The solution was heated in this way to a temperature of 180° C. The solution was pumped through a spinneret having 64 holes, each hole having a diameter of 1 millimeter. The so obtained filaments were drawn in total with a factor of 80 and dried in an hot air oven. After drying the filaments were bundled into a yarn and wound on a bobbin.

Subsequently the yarn was knitted into a fabric of 260 grams per square meter. The fabric was tested against cut resistance according to ASTM 1790. The required cutting force was measured. The results are given in Table 1.

Example 1

A dry blend was produced in a tumbler, the dry blend consisting of 5 wt. % of mineral fibers, sold under the trade name RB215-Roxul™ 11000 and 95 wt. % of the UHMWPE as used in comparative experiment A. The average diameter of the mineral fibers was 5.5 microns. A yarn according to the invention was produced out of the dry blend in the same way as the yarn in comparative experiment A was produced.

Subsequently the yarn was knitted into a fabric of 260 grams per square meter. The fabric was tested against cut resistance according to ASTM 1790. The required cutting force was measured. The results are given in Table 1.

Example 2

Example 1 was repeated, however the dry blend consisted of 7 wt. % of the mineral fibers and 93 wt. % of the UHMwPE.

Example 3

Example 1 was repeated, however the dry blend consisted of 9 wt. % of the mineral fibers and 91 wt. % of the UHMwPE.

Example 4

Example 1 was repeated, however the dry blend consisted of 11 wt. % of the mineral fibers and 89 wt. % of the UHMwPE.

Example 5

A dry blend was produced in a tumbler, the dry blend consisting of 7 wt. % of mineral fibers, sold under the trade name RB215-Roxul™ 1000 and 93 wt. % of the UHMWPE as used in comparative experiment A. A yarn according to the invention was produced out of the dry blend in the same way as the yarn in comparative experiment A was produced.

Subsequently the yarn was drawn with a factor of 2.5 at elevated temperature and wound on a bobbin again.

Subsequently the yarn was knitted into a fabric of 260 grams per square meter. The fabric was tested against cut resistance according to ASTM 1790. The required cutting force was measured. The results are given in Table 1.

TABLE 1

| Comp. Exp./Example | Tenacity [gram/denier] | ASTM 1790 cut force [N] |
|---|---|---|
| A | 18.9 | 5.2 |
| 1 | 17.9 | 7.9 |
| 2 | 14.9 | 8.2 |
| 3 | 14.0 | 8.6 |
| 4 | 13.8 | 10.8 |
| 5 | 28.0 | 8.0 |

The invention claimed is:

1. A cut resistant yarn comprising filaments and/or staple fibers, wherein the filaments and/or staple fibers contain a filler to improve cut resistance of the yarn, wherein said filler is a hard component which is a plurality of hard fibers having an average diameter of at most 25 microns, wherein the hard fibers are spun fibers.

2. The yarn according to claim 1, wherein the hard fibers have an average diameter which is at most 20 microns.

3. The yarn according to claim 1, wherein the yarn comprises 0.1-20 volume % of the hard fibers.

4. The yarn according to claim 1, wherein at least a part of the hard fibers have an aspect ration which is at least 3.

5. The yarn according to claim 1, wherein the hard fibers are produced out of glass, a mineral or a metal.

6. The yarn according to claim 1, wherein the hard fibers are spun fibers.

7. The yarn according to claim 1, wherein the yarn is formed of a ultra-high molecular weight polyethylene polymer.

8. The yarn according to claim 1, wherein the hard fibers are glass or mineral fibers spun by a rotation technique.

9. The yarn according to claim 1, wherein the filaments and/or staple fibers have a titer which is below 15 dtex per filament.

10. The yarn according to claim 1, the filaments and/or staple fibers are formed from a nylon, thermoplastic polyester, aramid or polybenzoxazol polymer.

11. The yarn according to claim 1, which yarn further comprises one or more single yarns of comprising a yarn, wire or thread formed of a glass, metal or ceramic material.

12. A woven or a knitted fabric comprising the yarn according to claim 1.

13. A product containing the yarn according to claim 1.

14. The product according to claim 13, wherein the product is a garment to protect persons from being cut.

15. The product according to claim 13, wherein the product is a product used for protection against injury by stabbing.

16. The product according to claim 13, wherein the product is a garment for use in meat industry, metal industry or wood industry.

17. The product according to claim 13, wherein the product is a side curtain for trucks, a tarpaulin for trucks, a soft sided luggage, a commercial upholstery, an airline cargo container or a fire hose sheet.

18. A garment comprising the yarn according to claim 1, wherein the garment is a glove, an apron, a pair of trousers, a cuff or a sleeve.

19. A process for producing the yarn according to claim 1 by:

a) mixing a polymer powder or polymer granules with a plurality of hard fibers;

b) melting or dissolving the polymer while mixing the polymer and the plurality of hard fibers;

c) spinning a yarn from the mixture obtained at step b).

20. A process for producing the yarn according to claim 1 by:

a) melting or dissolving a polymer;

b) mixing a plurality of hard fibers with the molten polymer or the polymer solution; and c) spinning a yarn from the mixture obtained at step b).

* * * * *